United States Patent [19]

Hyuga

[11] Patent Number: 4,632,318

[45] Date of Patent: Dec. 30, 1986

[54] KNIFE FEED SYSTEM IN ROTARY DRUM CUTTER

[75] Inventor: Kounosuke Hyuga, Kanagawa, Japan

[73] Assignee: The Japan Tobacco & Salt Public Corporation, Tokyo, Japan

[21] Appl. No.: 705,210

[22] Filed: Feb. 25, 1985

[30] Foreign Application Priority Data

Mar. 21, 1984 [JP] Japan ..... 59-052245

[51] Int. Cl.[4] ..... B02C 18/18; B02C 25/00

[52] U.S. Cl. ..... 241/37; 241/223; 241/294

[58] Field of Search ..... 241/101.2, 241, 223, 241/224, 239, 240, 300.1, 37, 33, 293, 294

[56] References Cited

U.S. PATENT DOCUMENTS 2,546,727 3/1951 Dearsley ..... 241/101.2

4,467,970 8/1984 Sagemuller ..... 241/101.2

*Primary Examiner*—Mark Rosenbaum

*Attorney, Agent, or Firm*—Murray and Whisenhunt

[57] ABSTRACT

A knife feed system in a rotary drum cutter having a rotary drum disposed in proximity to a raw material shredding port and a plurality of knives arranged at predetermined intervals on the rotary drum, in which the knives are each ejected by a predetermined length to keep constant the spacing between the knife edge and the shredding port. The knife feed system includes a knife feed mechanism provided for each of the knives, a drive unit for driving the knife feed mechanism, the driven unit being provided separately from the rotary drum a transmission mechanism disposed between the knife feed mechanism and the drive unit to transmit power from the latter to the former, and a control unit connected to the drive unit to control the latter, the control unit having a function capable of setting and changing the number of times of operation per unit time of the drive unit. The feed of knife can be set appropriately according to the kind of raw material to be shredded.

5 Claims, 8 Drawing Figures

KNIFE FEED SYSTEM IN ROTARY DRUM CUTTER

BACKGROUND OF THE INVENTION

The present invention relates to a knife feed system in a rotary drum cutter provided in a tobacco shredder or the like.

Generally, in a shredding machine for tobacco, tobacco leaves as raw material are conveyed under compression to a shredding port by means of two upper and lower press conveyors, the shredding port being formed in front of the press conveyors, and are shredded with a rotary drum cutter rotating in close proximity to the shredding port.

The rotary drum cutter is composed of a rotary drum and a plurality of knives disposed at predetermined intervals on the outer peripheral surface of the rotary drum. The cutting edge of each knife is ground continually during operation of the cutter by means of a grinder provided separately so as to be suited to a high speed processing over a long period of time. Further for maintaining constant the spacing between the knife edge and the shredding port, a knife feed system for feeding each knife continuously or intermittently little by little is provided in the interior of the rotary drum.

The abrasion loss of the knife differs depending on the raw materials to be shredded. If the feed of the knife is small despite of a large abrasion loss, it will be impossible to attain sharpness of the knife even after grinding and so consequently difficult to obtain shredded tobacco leaves of good quality, causing an increased loss of raw material. Furthermore if the knife is ejected to a larger extent than necessary despite a small abrasion loss, the knife which is expensive will be wasted. Therefore, it is necessary that the feed of the knife be changed according to the raw material to be shredded. In this connection, the knife feed system in conventional rotary drum cutters is constructed so that each knife is ejected in interlock with the rotation of the rotary drum. This construction was given rise to the problem that the replacement of parts must be done for adjusting the amount of ejection of the knife according to the kind of raw material used. An additional problem has existed in that when changing the knife the spacing between the knife and the shredding port must be adjusted under no-load rotation of the drum without feed of raw material, thus requiring much time for the adjustment.

SUMMARY OF THE INVENTION

The present invention has been accomplished in view of the above-mentioned circumstances, and it is the object thereof to provide a knife feed system in a rotary drum cutter capable of setting the knife feed rate arbitrarily according to the raw material to be shredded without the need of changing parts, and permitting easy adjustment at the time of changing knife.

More particularly, the present invention is characterized by including a knife feed mechanism attached to each knife support portion of a rotary drum; a drive unit for driving the knife feed mechanism, the drive unit being provided separately from the rotary drum; a transmission member provided between the knife feed mechanism and the drive unit to transmit the power of the latter to the former; and a control unit connected to the drive unit to control the latter, the control unit having a function capable of setting and changing the number of times of operation per unit time of the drive unit, in which the number of times of operation of the drive unit is changed at the time of change of raw material or knife.

BRIEF DESCRIPTION OF THE DRAWINGS

The accompanying drawings illustrate an embodiment of the present invention, in which.

DESCRIPTION OF A PREFERRED EMBODIMENT

An embodiment of the present invention will be described hereinunder with reference to the drawings.

Figure 1:
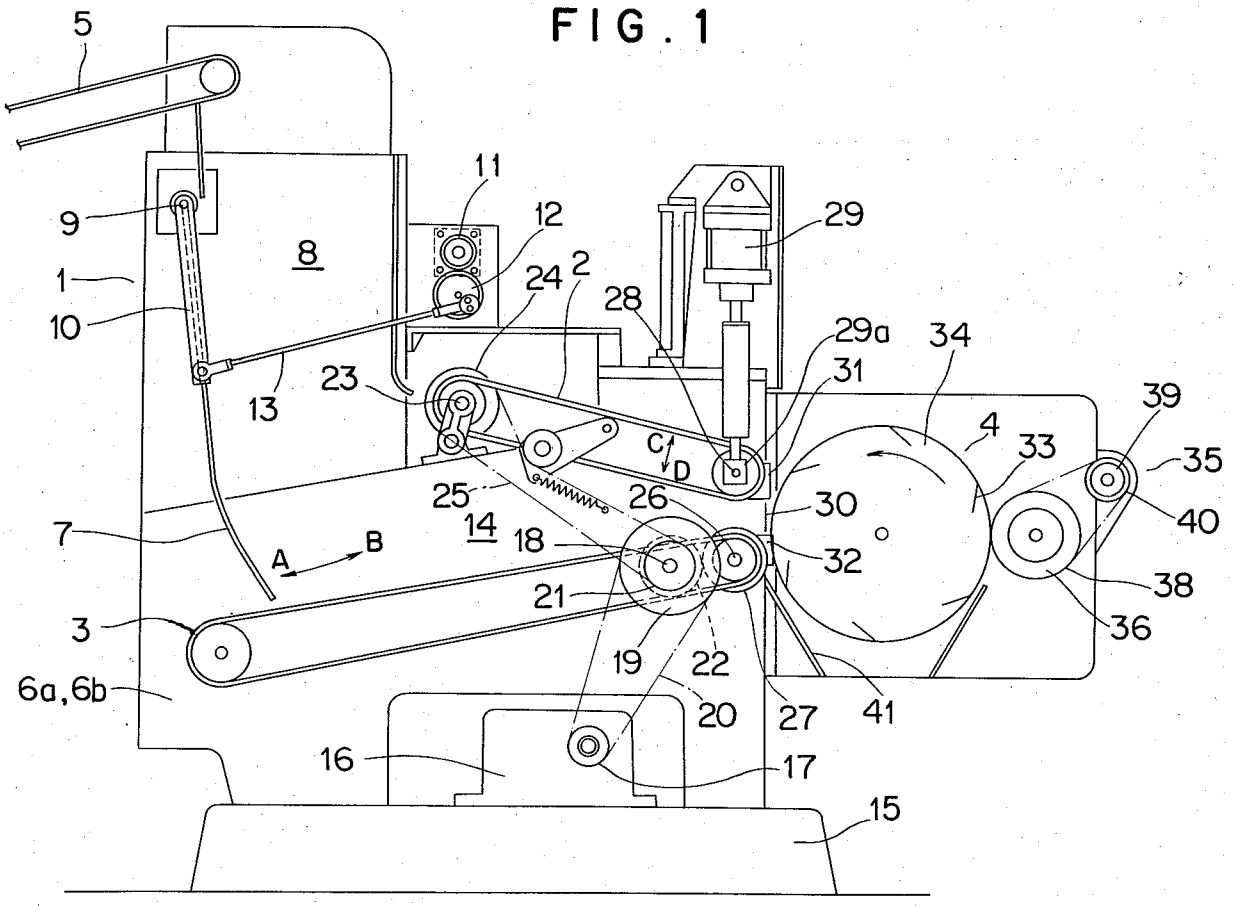
FIG. 1 is a schematic side view of a shredding machine for tobacco to which is applied the present invention.

Referring first to FIG. 1, there is illustrated the whole of a shredding machine for tobacco equipped with a knife feed system in a rotary drum cutter, the shredding machine comprising a hopper 1, upper and lower press conveyors 2 and 3 and a rotary drum cutter 4.

The hopper 1 serves as a guide for conducting tobacco raw material introduced therein from a belt conveyor 5 to between the upper and lower press conveyors 2 and 3, and it is composed of a part of side frames 6*a* and 6*b* and a raw material feed plate 7. The raw material feed plate 7 is attached to a link arm 10 which is mounted through a pin 9 within a feed passage 8 defined by the side frames 6*a* and 6*b*. To the link arm 10 is connected one end of a link arm 13 the other end of which is pivotally connected to a rotary plate 12 which is rotated by a motor 11. The raw material feed plate 7 is moved pivotally about the pin 9 in the directions of arrows A and B in FIG. 1 by means of the link arms 10 and 13 and the motor 11 to push in the tobacco raw material between the upper and lower press conveyors 2 and 3.

The upper and lower press conveyors 2 and 3 are disposed between the side frames 6*a* and 6*b* to convey the tobacco raw material under compression to the rotary drum cutter 4. The upper press conveyor 2 is shorter than the lower press conveyor 3, and a feed passage 14 is formed between the upper and lower press conveyors 2 and 3, the feed passage 14 being narrower on the side of the rotary drum cutter 4.

The upper and lower conveyors 2 and 3 are driven by a variable speed motor 16 with reduction unit mounted on a base 15. More specifically, a chain 20 is stretched between a sprocket 17 which is fixed onto an output shaft of the motor 16 and a main sprocket 19 which is rotatably mounted on an intermediate shaft 18 disposed on one side of the side frames 6*a* and 6*b*. To the main sprocket 19 are fixed an intermediate sprocket 21 and a main gear 22, and a chain 25 is stretched between the intermediate sprocket 21 and a driven sprocket 24 which is fixed to a tail-side wheel shaft 23 of the upper press conveyor 2. The main gear 22 is in mesh with a driven gear 27 which is fixed onto a head-side wheel shaft 26 of the lower press conveyor 3. Upon operation of the motor 16, the rotation of the motor is transmitted from the sprocket 17 to the main sprocket 19, intermediate sprocket 21 and main gear 22 through the chain 20, and from the intermediate sprocket 21 to the driven sprocket 24 through the chain 25, and further from the main gear 22 to the driven gear 27, so that the driven sprocket 24 and the driven gear 27 rotate in directions opposite to each other, causing the upper and lower press conveyors 2 and 3 to be driven so as to convey the tobacco raw material toward the rotary drum cutter 4.

The upper press conveyor 2 is pivotable in the directions of arrows C and D in FIG. 1 about the tail-side wheel shaft 23. To its head-side wheel shaft 28 are pivotally connected the fore end portions of cylinder rods 29*a* of press cylinders 29 which are mounted in an upright state at upper front portions of the side frames 6*a* and 6*b*. Thus, the upper press conveyor 2 is in a suspended state by the press cylinders 29.

Fixed to the fore end portions of the cylinder rods 29*a* of the press cylinders 29 is a press plate 31 which constitutes an upper side portion of a shredding port 30 through which the tobacco raw material is forced out to the rotary drum cutter 4.

The shredding port 30 is formed by the press plate 31, a blade receiving plate 32 mounted on the head side of the lower press conveyor 3, and right and left guide (not shown) which are extensions of the side frames 6*a* and 6*b*.

The pressing force of the upper press conveyor 2 and the press plate 31 is set by a reducing valve with relief (not shown) which regulates the pressure of fluid entering the press cylinders 29.

The tobacco raw material which has been pushed in between the upper and lower press conveyors 2 and 3 is compressed as it approaches the shredding port 30, and it is in the form of a flat lump when forced out of the shredding port.

The rotary drum cutter 4 is for shredding into a predetermined width the tobacco raw material which has been pushed out of the shredding port 30. It has a plurality of knives 33 which are each in an obliquely cut off shape from part of a cylinder and which are arranged on the outer peripheral surface of a rotary drum 34 so that their cutting edges project generally spirally to permit the knives 33 to seize and shred the raw material in the shredding port 30 and so that the built-in angle of the knife 33 when viewed from the outer peripheral surface is approximately constant in the axial direction. The rotary drum cutter 4 is disposed in close proximity to the shredding port 30.

The cutting edge of each knife 33 is ground continually during operation by means of a grinder 35 so as to be suited for a high speed processing over a long period of time. The grinder 35 is composed of a grinding wheel 36, a a griner motor (not shown) and a transmission mechanism for transmitting the rotation of the grinder motor to the grinding wheel 36, the transmission mechanism comprising pulleys 38, 39 and a belt 40. The grinder 35 reciprocates in the axial direction of the direction of the rotary drum cutter 4 (drum 34) while allowing the grinding wheel 36 to rotate.

The conveyance speed of the upper and lower press conveyors 2 and 3 and the rotational speed of the rotary drum cutter 4 are synchronized with each other to make constant the shredded width of the tobacco raw material. The numeral 41 in FIG. 1 denotes a discharge chute.

An example of the knife feed system of the present invention will be described below with reference to FIGS. 2 to 8.

Figure 2:
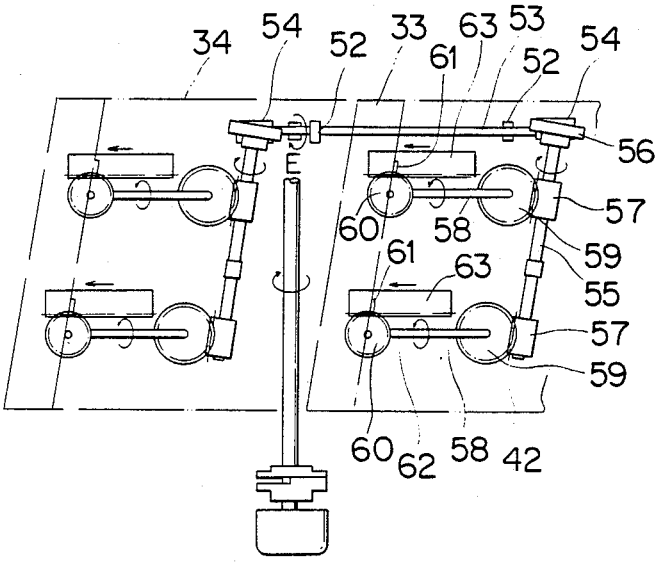
FIGS. 2 and 3 are schematic illustrations showing an example of the knife feed system of the invention.
Figure 3:
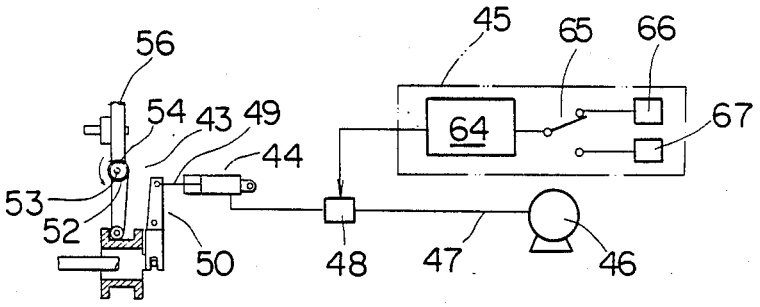

FIGS. 2 and 3 schematically illustrate the knife feed system which comprises a knife feed mechanism 42, a transmission mechanism 43, a drive unit 44 and a control unit 45.

The drive unit 44 comprises an air cylinder including a piston which is moved forward with compressed air upon opening of a solenoid valve 48 disposed in a compressed air supply line 47 extending from a compressor 46.

The transmission mechanism 43 is composed of a pivoting member 50 which is pivotally moved by the piston rod 49, a slide case unit 51 which is reciprocated by the pivoting member 50, and a one-way clutch 52 which is rotated in one direction when the slide unit case 51 moves forward. Worm gears 54 are mounted on both ends of a clutch shaft 53 of the one-way clutch 52.

The knife feed mechanism 42 is composed of a helical gear 56 mounted on one end of a shaft 55 and meshing with one worm gear 54; worm gears 57 mounted on one end side of the shaft 55 and on the other end of the same shaft; helical gears 59 mounted on one ends of knife feed shafts 58 and meshing with the worm gears 57; bevel gears (pinions) 60 mounted on the other ends of the knife feed shafts 58; and slide blocks 63 each having a pawl portion 61 which engages the knife 33 and a bevel gear (rack) 62 which engages the bevel gear 60.

The control unit 45 is composed of a preset counter 64, a pulse generator 66 and a time pulse generator 67, the generators 66 and 67 being connected to the preset counter 64 through a change-over switch 65. The pulse generator 66 provides a pulse signal interlockedly with the rotation of the rotary drum 34, while the time pulse generator 67 is not interlocked with the rotation of the rotary drum 34 but operates the drive unit 44 at every time (once per unit shredded amount) which is inversely proportional to a preset flow rate. The preset counter 64 outputs one operating pulse to the solenoid valve 48 when it has received a predetermined number of pulse signals from the pulse generator 66 or time pulse generator 67. The preset number of input pulse signals can be changed.

When an operating pulse is applied from the control unit 45 to the solenoid valve 48, the valve 48 is opened to operate the drive unit 44, so that the piston rod 49 moves forward and a rotational force is transmitted to the shaft 55 via pivoting member 50, slide case unit 51 and clutch shaft 53. This rotational force is transmitted to the knife feed shaft 58 through the engagement of the worm gears 57 with the helical gears 59, and is then converted to a linear motion of the slide blocks 63 through the engagement of the bevel gears 60 and 62, so that the knife 33 is fed one pitch by the pawl portions 61.

Figure 4:
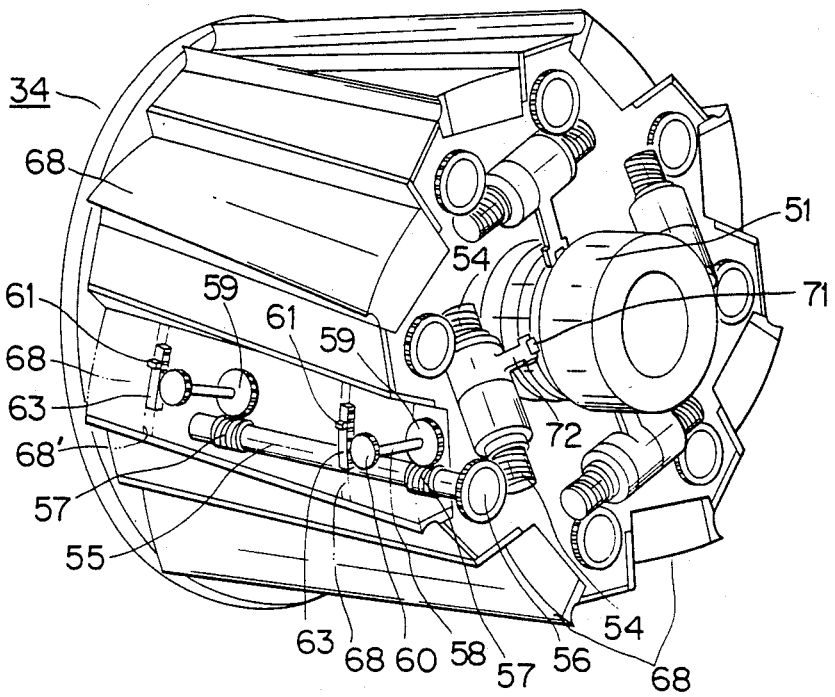
FIG. 4 is a perspective view of a rotary drum, showing an arrangement of the knife feed system, etc.

FIG. 4 is a perspective view of the rotary drum 34 with the knives 33, etc. omitted, in which the knife feed mechanism 42 is disposed below each knife support portion 68 so that the helical gear 56 is located at one end face of the rotary drum 34. The support portion 68 is formed with grooves 68' for guiding the movement of the slide blocks 63.

Figure 5:
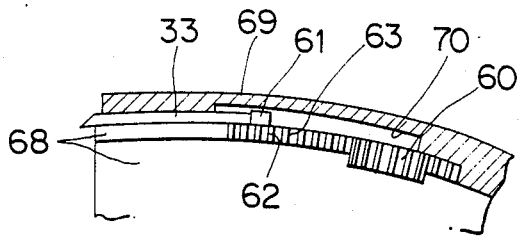
FIG. 5 is an explanatory view showing a clamped state of knife.

As shown in FIG. 5, the knife 33 is clamped by a clamp plate 69 so that it can be fed onto the support portion 68. The inner surface of the clamp plate 69 is formed with a recess 70 so as not to impede the movement of the pawl portion 61.

The clutch shaft 53 of the transmission mechanism 43 is disposed one per two sets of knife feed mechanisms 42 at one end face of the rotary drum 34 where the helical gear 56 is disposed. That is, one clutch shaft 53 transmits power to two sets of knife feed mechanisms 42.

The clutch shaft 53 is centrally provided with an engaging arm 72 having a roller portion 71 which engages the slide case unit 51.

Figure 6:
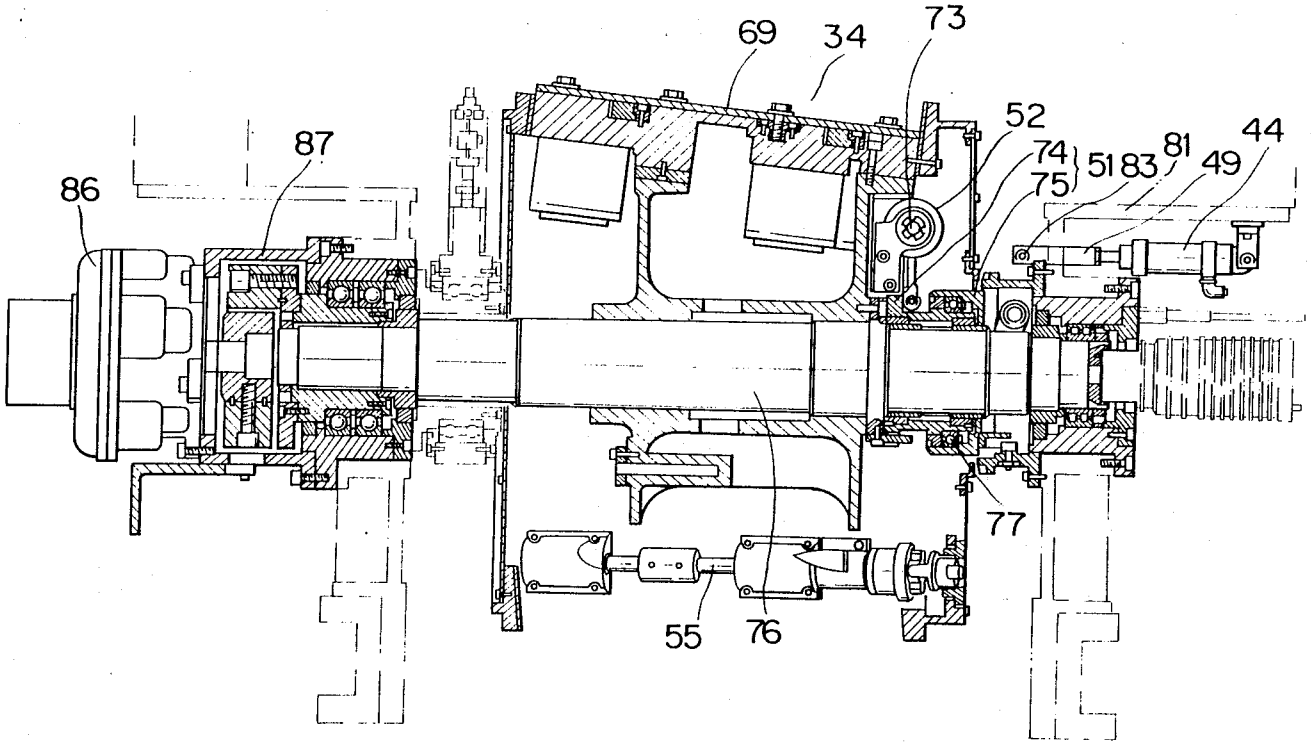
FIG. 6 is a detailed sectional view of a rotary drum cutter.

FIG. 6 is a detailed sectional view of the rotary drum cutter 4, in which the clutch shaft 53 is attached to one end face of the rotary drum 34 so as to be pivotable about a pin 73. The slide case unit 51 comprises case members 74 and 75, and it is fitted on a main shaft 76 of the rotary drum 34 axially movably. One case member 74 and the other case member 75 are combined through a bearing 77. One case member 74 rotates together with the rotary drum 34 relative to the other case member 75.

Figure 7:
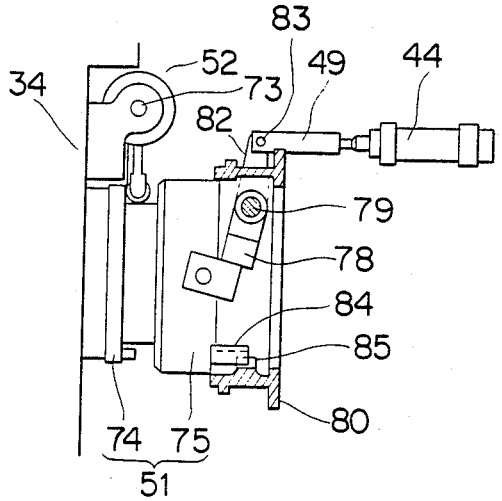
FIGS. 7 and 8 are illustrative of a pivoting member of a transmission mechanism.
Figure 8:
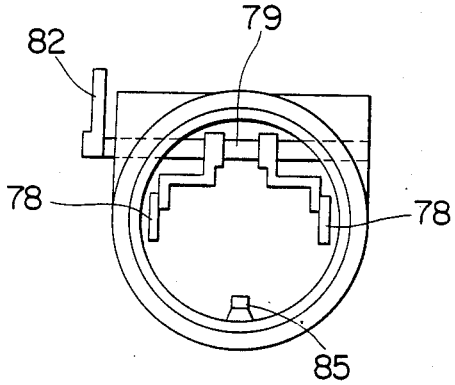

To the other case member 75 are connected lever pieces 78 of the pivoting member 50, as shown in FIG. 7. The lever pieces 78, as shown in FIG. 8, are fixed to a pin 79 and mounted pivotably within a lever case 80 which is attached to a frame 81 (see FIG. 6). The pivoting member 50 is composed of the lever pieces 78, pin 79 and lever case 80.

To an end portion of the pin 79 is attached an arm piece 82 to which is connected the fore end portion of the piston rod 49 through a pin 83.

The drive unit 44 is fixed to the frame 81 in proximity to the lever case 80.

The case member 75 is provided with a guide portion 84, while in the lever case 80 is provided a guide roller 85 which engages the guide portion 84.

In FIGS. 2 to 6, the numeral 86 denotes a hydraulic drum for driving the rotary motor 34 and the numeral 87 denotes a coupling for connecting the hydraulic motor 86 with the main shaft 76.

The following description is now provided about the operation of the above embodiment.

In shredding the raw material, the change-over switch 65 is turned to the pulse generator 66, whereby pulse signals are fed from the pulse generator 66 to the preset counter 64. When the number of input pulses reaches a preset value, an operating pulse is provided to the solenoid valve 48. The solenoid valve 48 is thereby opened, so that compressed air is fed from the compressor 46 to the drive unit 44 to let the piston rod 49 move forward, with the resultant pivotal movement of the lever pieces 78 causing the slide case unit 51 to move to the right in FIG. 7. At this time, the case member 74 rotates together with the rotary drum 34 relative to the case member 75. With the movement of the slide case unit 51, the clutch shaft 53 rotates in the direction of arrow E in FIG. 2, and this rotational force is transmitted to the knife feed mechanism 42, so that the knife 33 is fed one pitch as previously described.

In this way, the knife 33 is fed one pitch at a time in interlock with the rotation of the rotary drum 34, that is, the knife 33 is ejected by a length corresponding to its length ground by the grinder 35, to keep constant the spacing between the cutting edge of the knife 33 and the shredding port 30.

When the abrasion loss of the knife changes with change of the kind of raw material, the preset number of input pulse signals in the preset counter 64 is changed. For example, when the abrasion loss is large, the said number is set small. As an example, a change is made from six pulse signals so far received to output an operating pulse, to three signals to output an operating signal. By so doing, the number of operation of the drive unit 44 per unit time is doubled, that is, the feed of the knife is doubled.

For adjusting the amount of ejection of the cutting edge of the knife 33 at the time of replacement of the knife, the rotary drum 34 is rotated and the knife feed rate is increased while grinding the knife. More specifically, the set number of input pulse signals in the preset counter 64 is changed to about one fourth of that in normal shredding operation, whereby the knife feed rate becomes four times higher, thus permitting a remarkable shortening of the adjusting time. When a predetermined amount of projection of the knife is reached and so the adjustment is over, the preset number of input pulse signals in the preset counter 64 is returned to the value in normal shredding operation.

Although in the above embodiment the present invention was applied to the rotary drum cutter 4 having spiral knives 33, it is also applicable to a rotary drum cutter having planar knives.

Furhter, even other than rotary drum cutters in tobacco shredding machines, the present invention is also applicable to, for example, rotary drum cutters in pulp shredding machines.

According to the present invention, as set forth hereinabove, a drive unit for driving the knife feed mechanism is provided separately from the rotary drum, and a control unit for controlling the drive unit, having a function capable of setting and changing the number of times of operation per unit time of the drive unit, is connected to the drive unit. With such arrangement, the time required for the adjusting operation can be shortened be changing the number of operation of the drive unit, and hence the adjusting work efficiency can be improved to a remarkable extent. Moreover, since the knife feed can be changed by merely changing the number of times of operation of the drive unit, an appropriate shredding spacing is ensured even when the kind of raw material to be shredded is changed. Further, the expensive knife can be used effectively because the knife feed can be set appropriately according to the kind of raw material.

What is claimed is:

1. A rotary drum cutter including a knife feed system, said rotary drum cutter having a rotary drum disposed in proximity to a shredding port through which raw material is urged, and a plurality of knives arranged in predetermined intervals on said rotary drum, said knives each having a cutting edge spaced from said shredding port, said knives being movable by a predetermined distance to keep constant the spacing between said cutting edge of each knife and said shredding port, said knife feed system including:

knife feed means attached to a support portion for each of said knives on said rotary drum;

drive means for driving said knife feed means, said drive means being provided separately from said rotary drum;

transmission means disposed between said knife feed means and drive means for transmitting power from said drive means to said knife feed means; and pulse control means connected to said drive means for generating operating pulses for operating said drive means, said control means setting and changing the number of times of operation of said drive means per unit time.

2. A rotary drum cutter including a knife feed system, said rotary drum cutter having a rotary drum disposed in proximity to a shredding port through which raw material is urged, and a plurality of knives arranged at predetermined intervals on said rotary drum, said knives each having a cutting edge spaced from said shredding port, said knives being ejectable by a predetermined length to keep constant the spacing between the cutting edge of each knife and said shredding port, said knife feed system including:

a knife feed mechanism attached to a support portion for each of said knives on said rotary drum;

a drive unit for driving said knife feed mechanism, said drive unit being provided separately from said rotary drum;

a transmission mechanism disposed between said knife feed mechanism and said drive unit for transmitting power from said drive unit to said knife feed mechanism; and a control unit connected to said drive unit for controlling said drive unit, said control unit setting and changing the number of times of operation of said drive unit per unit time.

3. A rotary drum center as claimed in claim 2, wherein said control unit includes an operating pulse generator.

4. A rotary drum center as claimed in claim 3, wherein said operating pulse generator is a preset counter.

5. A rotary drum center as claimed in claim 3, and further including a pulse generator and a time pulse generator, said pulse generator and said time pulse generator being connected to said operating pulse generator.

* * * * *